US008790571B2

(12) United States Patent
Belhadjhamida et al.

(10) Patent No.: US 8,790,571 B2
(45) Date of Patent: Jul. 29, 2014

(54) MANUFACTURE OF COMPOSITE COMPONENTS BY POWDER METALLURGY

(75) Inventors: Abdelhakim Belhadjhamida, Belleville (CA); Donald Williams, Kingston (CA); John Davies, Carrying Place (CA)

(73) Assignee: Kennametal Inc., Latrobe, PA (US)

( * ) Notice: Subject to any disclaimer, the term of this patent is extended or adjusted under 35 U.S.C. 154(b) by 534 days.

(21) Appl. No.: 12/994,536

(22) PCT Filed: May 28, 2009

(86) PCT No.: PCT/US2009/045528

§ 371 (c)(1),
(2), (4) Date: Nov. 24, 2010

(87) PCT Pub. No.: WO2009/146385

PCT Pub. Date: Dec. 3, 2009

(65) Prior Publication Data

US 2011/0070119 A1 Mar. 24, 2011

Related U.S. Application Data

(60) Provisional application No. 61/056,694, filed on May 28, 2008.

(51) Int. Cl.
*B22F 7/02* (2006.01)
*B22F 7/06* (2006.01)

(52) U.S. Cl.
USPC ..... 419/7; 419/5; 419/36; 419/38; 419/40; 419/47

(58) Field of Classification Search
None
See application file for complete search history.

(56) References Cited

U.S. PATENT DOCUMENTS

| | | | | | |
|---|---|---|---|---|---|
| 3,362,838 | A | * | 1/1968 | Parikh et al. | 106/198.1 |
| 3,989,863 | A | * | 11/1976 | Jackson et al. | 427/367 |
| 4,147,538 | A | | 4/1979 | Yajima et al. | |
| 4,591,480 | A | * | 5/1986 | Morishita et al. | 419/9 |
| 4,596,691 | A | * | 6/1986 | Ruppert et al. | 419/3 |
| 4,793,968 | A | * | 12/1988 | Mosser et al. | 428/550 |
| 4,871,621 | A | * | 10/1989 | Bagley et al. | 428/549 |
| 2006/0083652 | A1 | | 4/2006 | Liu et al. | |

FOREIGN PATENT DOCUMENTS

JP 63210201 * 8/1988

OTHER PUBLICATIONS

International Preliminary Report on Patentability, PCT/US09/45528, dated Nov. 30, 2010, 6 pages.
International Search Report, PCT/US09/45528, dated Jul. 13, 2009, 2 pages.
Written Opinion, PCT/US09/45528, dated Jul. 13, 2009, 6 pages.

* cited by examiner

*Primary Examiner* — George Wyszomierski
*Assistant Examiner* — Ngoclan T Mai
(74) *Attorney, Agent, or Firm* — Matthew W. Smith, Esq.

(57) ABSTRACT

A method for preparing an article is disclosed. The method comprises compacting a mixture of a first pre-alloyed powder and a lubricant to thereby form a green part having a green strength sufficient to permit mechanical handling; applying a slurry to a surface of the green part to thereby form a slurry coated green part, wherein the slurry comprises a second pre-alloyed powder, a binder, and a solvent; and heating the coated green part to a temperature below a solidus temperature of the first pre-alloyed powder and between a solidus temperature and a liquidus temperature of the second pre-alloyed powder to thereby solid state sinter the first pre-alloyed powder into a sintered core and to liquid state sinter the second pre-alloyed powder into a continuous alloy coating over the sintered core.

25 Claims, 1 Drawing Sheet

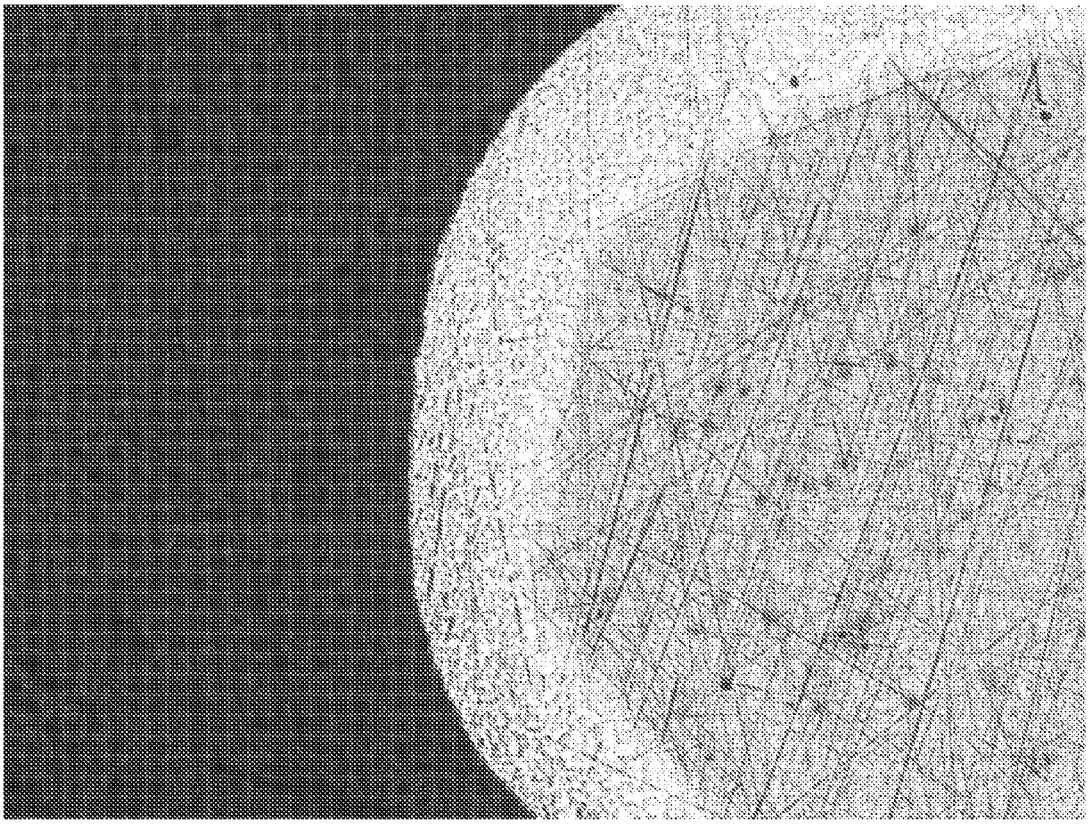

MANUFACTURE OF COMPOSITE COMPONENTS BY POWDER METALLURGY

REFERENCE TO RELATED APPLICATIONS

This application is the U.S. national stage application of International Patent Application No. PCT/US2009/045528, filed May 28, 2009, and claims the benefit of U.S. Provisional Application Ser. No. 61/056,694, filed May 28, 2008, the entire disclosures of which are incorporated herein by reference.

FIELD OF THE INVENTION

The present invention generally relates to a method of manufacturing composite components by powder metallurgy.

BACKGROUND OF THE INVENTION

The manufacture of components by solid state powder metallurgy (PM) occurs by pressing a powder of a metal, a metal alloy, or a metal composite in a die, which is followed by solid state sintering at a temperature below the solidus temperature of the powder metal. Component parts in the automotive industry are often made by solid state powder metallurgical methods.

Sintering below solidus temperature has certain advantages. For example, the compressed powder undergoes relatively little shrinkage. Furthermore, the compressed powder undergoes relatively little shape change during sintering. The shrinkage is generally less than 2 vol. %, which compares favorably to liquid phase sintering, in which the material may shrink by up to 15 to 20 vol. %. Accordingly, shape retention of solid state sintering is much better than that of liquid phase sintering. Moreover, since solid state powder metallurgy occurs below the solidus temperature, it is more cost effective than liquid state sintering, which is typically done at a temperature above solidus but below the liquidus temperature.

Components formed by solid state sintering, however, may not be fully dense and are often characterized by a high porosity level of 10 to 20 vol. %. Although the component parts have enough bulk strength for the intended applications, the surface is often not resistant to wear and corrosion because the alloys selected are typically ferrous alloys, and the porous surface allows penetration of air and water. In order to enhance surface wear and corrosion resistance, the industry has adopted a variety of surface treatments, such as carburizing, nitriding, steam treating, burnishing, and induction hardening.

SUMMARY OF THE INVENTION

Among the aspects of the present invention may be noted the provision of a process for forming complex composite parts having a wear and corrosion resistant outer layer.

Briefly, therefore, the present invention is directed to a method for preparing an article. The method comprises compacting a mixture of a first pre-alloyed powder and a lubricant to thereby form a green part having a green strength sufficient to permit mechanical handling; applying a slurry to a surface of the green part to thereby form a slurry coated green part, wherein the slurry comprises a second pre-alloyed powder, a binder, and a solvent; and heating the coated green part to a temperature below a solidus temperature of the first pre-alloyed powder and between a solidus temperature and a liquidus temperature of the second pre-alloyed powder to thereby solid state sinter the first pre-alloyed powder into a sintered core and to liquid state sinter the second pre-alloyed powder into a continuous alloy coating over the sintered core.

Other objects and features will be in part apparent and in part pointed out hereinafter.

BRIEF DESCRIPTION OF THE DRAWINGS

FIG. 1 is a photograph of a gear comprising a Fe-based alloy core coated with a highly wear resistant Co-based alloy shell manufactured according to process of the present invention.

Corresponding reference characters indicate corresponding parts throughout the drawings.

DESCRIPTION OF THE EMBODIMENT(S) OF THE INVENTION

The present invention is directed to a method of forming an article by powder metallurgy. The article comprises a metallic core that is formed by solid state sintering and a metallic shell formed by liquid state sintering. Both solid state and liquid state sintering may occur in a single heating cycle. By coating the solid state sintered core with a wear and corrosion resistant metallic shell, the article is characterized by improved wear and corrosion resistance compared to articles formed by conventional solid state powder metallurgy.

The main advantage of this process is to impart wear or corrosion resistance to a solid state sintered component by applying a high alloy coating, thereby, eliminating any subsequent surface treatment. Another advantage is that only one sintering cycle is needed to accomplish both solid state sintering of the substrate and liquid phase sintering of the outer layer. The process provides good dimensional control and economy above conventional powder metallurgy processes. Moreover, large components having a range of complex shapes, such as, for example, gears, can be manufactured to have a corrosion resistant and wear resistant coating by the process of the invention process.

An iron-based alloy commonly used in powder metallurgy, such as Fe0208 (iron/copper/carbon), is an ideal material to be coated by the process of the present invention. Fe0208 is relatively ductile, such that it lends itself to the re-sizing or coining of the part after sintering. With a hard wear resistant outer layer, the potential need for secondary operations is minimized or eliminated.

The process of the present invention may be used to produce bearing products. In many bearing applications, the ability to sinter high-alloy coatings onto parts manufactured by powder metallurgy resulting in surfaces that exhibit good rolling contact fatigue properties would be attractive.

The method of the present invention generally involves coating a green core part formed from a pre-alloyed metallic powder with a slurry comprising the same or a different pre-alloyed metallic powder and sintering the coated green part in a high temperature heat cycle. In a first step, a composition comprising a pre-alloyed metallic powder and a lubricant is prepared, which is formed into a green part having sufficient green strength to allow for mechanical handling without distorting the part. The green part is then coated with a metal slurry comprising a pre-alloyed metallic powder, a binder, a solvent, and optionally a surfactant and defoaming agent. The part is then subjected to a heat cycle to remove the binder followed by high temperature sintering. The sintering temperature is chosen such that the green part (the article's "core") is solid state sintered whereas the coating alloy (the article's "shell") undergoes liquid phase sintering. The metals for the core and the shell are selected such that a sintering temperature is capable of solid state sintering the core metal below its solidus temperature while sintering the shell metal above its solidus temperature but below its liquidus temperature.

After sintering, the article comprises a strong, but not fully dense core coated with a porosity-free, highly alloyed outer layer. The bond between the two metals is a strong diffusion bond.

The green part, which becomes the core of the finished article, is prepared by pressing a composition comprising pre-alloyed metallic powder and a lubricant into a desired shape. Accordingly, the composition for preparing the core comprises pre-alloyed metallic powder and lubricant. The pre-alloyed metallic powder component typically makes up between 90 and 99.9 wt. % of the composition, more typically between 98 and 99.5 wt. %, even more typically between 99 and 99.5 wt. %. The lubricant portion comprises between 0.1 and 10 wt. %, more typically between 0.5 and 2 wt. %, still more typically between about 0.5 and about 1 wt. %

The pre-alloyed metallic powders are typically ferrous alloy powders, which may comprise nickel, carbon, copper, molybdenum, chromium, tungsten, and manganese as alloying materials. Carbon is typically added to ferrous alloys as a hardening agent. The carbon content may vary between about 0.1 and about 3 wt. %, typically between about 0.2 and about 1.7 wt. %. Nickel and manganese may be added to increase the alloy's tensile strength and its chemical stability. Nickel may be added in an amount between about 0.1 and about 8 wt. %, more typically between about 0.1 and about 2 wt. %. Manganese may be added in an amount between about 0.1 and about 4 wt. %, such as between about 1 and about 1.5 wt. %. Molybdenum, chromium, and tungsten may be added to increase the hardness of the alloy. These may be added in amounts between about 0.1 and about 10 wt. %, more typically between about 0.1 and about 1 wt. %. Copper may be present in amounts between about 0.1 and about 5 wt. %. Exemplary ferrous alloys, including the nominal compositions of each, are shown in the following:

| Identity | Fe | C (wt. %) | Cu (wt. %) | Ni (wt. %) | Mo (wt. %) |
|---|---|---|---|---|---|
| FC-0208 | Balance | 0.8 | 2 | | |
| FN-0205 | Balance | 0.5 | | 2 | |
| F-0008 | Balance | 0.8 | | | |
| FL-4205 | Balance | 0.4 | | 0.35-0.50 | 0.5-0.70 |

The ferrous alloys described above are employed as powders. In the currently preferred embodiments, the method of the present invention involves compacting pre-alloyed metallic powders. The ferrous alloy powders preferably have a mesh size of −35 (less than about 500 micrometers), more preferably a mesh size of −45 (less than about 354 micrometers), even more preferably about −50 (less than about 297 micrometers), such as about −60 (less than about 250 micrometers). Powders having the above particle sizes may be formed by means known in the art, including milling, atomization, chemical deposition, and other methods.

The lubricant added to the composition may be a carboxylic acid or carboxylate derivative having at least about 14 carbon atoms, preferably a saturated carboxylic acid or carboxylate derivative having at least 14 carbons or an unsaturated carboxylic acid or carboxylate derivative having at least 18 carbon atoms. Carboxylate derivatives include metal soaps of carboxylic acids and esters of carboxylic acids. In a preferred embodiment, the lubricant may be selected from among stearic acid or a stearate metal soap, such as zinc stearate, calcium stearate, lithium stearate, aluminum stearate, or magnesium stearate.

To form the green part, a composition comprising the pre-alloyed metallic powder and lubricant is prepared by conventional mixing, such as by ball milling, hammer mill, grinding, stirring, fluidized bed, and so forth. The metallic powder/lubricant composition is then transferred into the die cavity, which determines the shape of the final component. Pressure is applied to the die through top and bottom punches to compact the metal powder and lubricant composition. The compacting pressure may be between 10 tons/in$^2$ and 60 tons/in$^2$ (between about 130 MPa and about 830 MPa). The pressure chosen depends upon the identity of the ferrous alloy powder and the desired density of the green part. The punches are then retracted and the part is then ejected from the die. Compacting the ferrous alloy powders at these pressures may be used to form a green part of any desired shape and having sufficient green strength to allow for mechanical handling without distorting the part.

The metal slurry comprises metallic powder, solvent, and a binder. The metal slurry may optionally contain a defoaming agent and a surfactant. The relative volume proportion of metallic powder and slurry in the metal slurry may be between about 30 and about 60 vol. % metallic powder and between about 40 to about 70 vol. % solvent. The relative proportion of metallic powder to solvent expressed in terms of a ratio of weight of metallic powder to weight of solvent may be from about 2:1 to about 15:1, preferably from about 6:1 to about 13:1, even more preferably from about 9:1 to about 11:1, such as about 10:1. Stated yet another way, the metallic powder may be present in the metal slurry in an amount between about 60 wt. % and about 95 wt. %, more preferably between about 82 wt. % and about 93 wt. %, even more preferably between about 90 wt. % and about 92 wt. %.

The metal slurry composition further comprises between about 0.5 and about 5 wt. % binder. Optionally, the metal slurry may comprise between about 0.05 and about 2 wt. % defoaming agent, preferably between about 0.25 and about 1 wt. % defoaming agent. Optionally, the metal slurry may further comprise between about 0.05 and about 2 wt. % wetting agent, preferably between about 0.25 and about 1 wt. % wetting agent. The metal slurry is preferably aqueous in that water is the predominant or even the only solvent, although alcohols such as methanol, ethanol, propanols, and butanols may be used as supplementary solvents, as the primary solvent, or even as the only solvent.

Applicable metal alloys that may be added as powders to the metal slurry include cobalt-based alloys, nickel-based alloys, and iron-based alloys. Metal alloys potentially applicable include any that are available in powder form, wherein the powder particles can bond to each other by sintering, when heat is applied.

Certain wear and corrosion resistant cobalt-based and nickel-based alloys are distributed by Deloro Stellite Company, Inc. under the trade designations Stellite®, Tribaloy®, and Deloro®.

In one embodiment, the powder employed in the invention is a Co-based alloy, which may be alloyed with nickel, iron, chromium, manganese, molybdenum, and tungsten. Nonmetallics may be added to the Co-based alloys, including carbon, boron, phosphorus, sulfur, and silicon.

In one embodiment, the Cobalt-based alloy comprises Cr and W as major components and may further comprise Ni, Fe, C, Mn, Si, and Mo in relatively low or trace amounts. For example, the cobalt-based alloy may comprise between about 21 wt % and about 35 wt % Cr, between about 4 wt % and about 19 wt % W, up to about 3 wt % Ni, up to about 5 wt % Fe, between about 0.4 wt % and about 3.5 wt % C, up to about 1.5 wt % Mn, between about 0.1 wt % and about 1.5 wt % Si, and up to about 1.5 wt % Mo, and the balance Co. Exemplary Stellite® alloys within this group include Stellite® 1, Stellite® 1C, Stellite® 3, Stellite® 4, Stellite® 4B, Stellite® 4LC, Stellite® 6, Stellite® 7, Stellite® 12, Stellite® 19, Stellite® 20, Stellite® 33, Stellite® 35, Stellite® 95, Stellite® 98M2, Stellite® 100, Stellite® 152, Stellite® 156, Stellite® 157, Stellite® 190, Stellite® 506, Stellite® 694, Stellite® Star J, among others. Stellite® 3, for example, has a nominal composition of 2.45 wt % C, 31 wt % Cr, 1 wt. % Mn, 1 wt % Si, and 13 wt % W, and may comprise up to 3 wt % Ni and Fe.

In one embodiment, the Cobalt-based alloy comprises Cr, W, and Ni as major components and may further comprise Fe, C, Mn, Si, and Mo in relatively low or trace amounts. For example, the cobalt-based alloy may comprise between about 20 wt % and about 35 wt % Cr, between about 2 wt % and about 15 wt % W, between about 6 wt % and about 24 wt % Ni, up to about 4 wt % Fe, between about 0.1 wt % and about 2 wt % C, up to about 1.5 wt % Mn, between about 0.3 wt % and about 3 wt % Si, up to about 3 wt % B, and the balance Co. Exemplary Stellite® alloys within this group include Stellite® 25, Stellite® 31, Stellite® 36, Stellite® 107, Stellite® 188, Stellite® 306, Stellite® F, Stellite® SF1, Stellite® SF6, Stellite® SF12, Stellite® SF20, among others.

In another embodiment, the Cobalt-based alloy comprises Cr and Mo as major components and may further comprise Ni, Fe, C, Mn, and Si in relatively low or trace amounts. For example, the cobalt-based alloy may comprise between about 26 wt % and about 34 wt % Cr, between about 4 wt % and about 18 wt % Mo, up to about 3 wt % Ni, up to about 3 wt % Fe, between about 0.2 wt % and about 3 wt % C, up to about 1.5 wt % Mn, between about 0.5 wt % and about 1.5 wt % Si, up to about 0.5 wt % B, and the balance Co. Exemplary Stellite® alloys within this group include Stellite® 21, Stellite® 701, Stellite® 703, Stellite® 704, Stellite® 706, Stellite® 706K, Stellite® 712, and Stellite® 720, Stellite® 790, among others.

Still other cobalt-based alloys may be employed, having relatively higher proportions of iron and nickel. For example, the cobalt-based alloy may comprise between about 8 wt % and about 20 wt % Fe and/or between about 1 wt % and about 8 wt % Ni. These alloys may further comprise between about 26 wt % and about 33 wt % Cr, up to about 14 wt % Mo, between about 0.1 wt % and about 3.5 wt % C, up to about 1 wt % Mn, and up to about 1.5 wt % Si. Exemplary Stellite® alloys within this group include Stellite® 208, Stellite® 238, Stellite® 250, Stellite® 251, Stellite® 2006, Stellite® 2012, and Stellite® 6113, among others.

Alloys within the Tribaloy® alloy family are disclosed in U.S. Pat. Nos. 3,410,732; 3,795,430; 3,839,024; and in pending U.S. application Ser. No. 10/250,205. Specific alloys in the cobalt-based Tribaloy® family are distributed under the trade designations T-400, T-800, T-400C, T-401, and T-900. Tribaloy® typically comprise between about 8 and about 18 wt % Cr, between about 20 and about 33 wt % Mo, between about 0.5 and about 4 wt % Si, balance cobalt, but other components, such as iron, nickel, and vanadium may be present, typically in amounts between about 0.5 and about 3 wt %. The nominal composition of T-400 is Cr—8.5%, Mo—29 wt %, Si—2.6 wt %, and balance Co. The nominal composition of T-800 is Cr—18 wt %, Mo—28 wt %, Si—3.4 wt %, and balance Co. The nominal composition of T-400C is Cr—14 wt %, Mo—26 wt %, Si—2.6 wt %, and balance Co. The nominal composition of T-900 is Ni—16 wt %, Cr—18 wt %, Mo—25 wt %, Si—2.7 wt %, and balance Co. The nominal composition of T-401 is Cr—16 wt %, Mo—22 wt %, Si—1.2 wt %, and balance cobalt.

In one embodiment, the powder employed in the invention is a nickel-based alloy, which may be alloyed with iron, chromium, manganese, molybdenum, and tungsten. Nonmetallics may be added to the Co-based alloys, including carbon, boron, phosphorus, sulfur, and silicon.

Nickel-based alloys include Tribaloy® T-700 and Tribaloy® T-745 comprising between about 14 and 28 wt % Cr, between about 24 and about 34 wt % Mo, between about 1 and about 4 wt % Si, up to about 0.1 wt % C, up to about 3 wt % Fe, up to about 2 wt % Co, the balance being Ni. The nominal composition of T-700 is 1.5 wt % Co, 15.5 wt % Cr, 32.5 wt % Mo, 3.4 wt % Si, and the balance Ni. The nominal composition of T-745 is 26 wt % Cr, 26 wt % Mo, 1.5 wt % Si, and the balance Ni.

Additional nickel-based alloys are sold under the trade name Deloro®, and they typically comprise between about 0.2 and about 6 wt %. Fe, between about 0.5 and about 4 wt %. B, between about 1 and about 5 wt. % Si, and between about 0.03 to about 1 wt. % C, with the balance being Ni. Optional components include Co, Al, Cr, Mo, Mn, and W. Exemplary Deloro® alloys include Deloro® 15, Deloro® 21, Deloro® 22, Deloro® 23, Deloro® 25, Deloro® 30, Deloro® 33, Deloro® 35, Deloro® 38, Deloro® 40, Deloro® 45, Deloro® 46, Deloro® 49, Deloro® 50, Deloro® 55, Deloro® 56, Deloro® 60, Deloro® 62, Deloro® 75, Deloro® 90, Deloro® 99, Deloro® 711, and Deloro® 721.

In one embodiment, the powder employed in the invention is an iron-based alloy, which may be alloyed with cobalt, chromium, manganese, molybdenum, and tungsten. Nonmetallics may be added to the Co-based alloys, including carbon and silicon.

Iron-based alloys are available from Deloro Stellite Company, Inc. under the trade name Delcrome®, and they may comprise between about 4 and about 10 wt. % Co, between about 0.6 and about 5 wt. % C, between about 2 and about 30 wt. % Cr, between about 0.1 and about 4 wt. % Mn, between about 4 and about 22 wt. % Mo, between about 0.5 and about 3 wt. % Si, and between about 3 and about 9 wt. % W. The nominal composition of Delcrome® 93, for example, is 6 wt. % Co, 3 wt. % C, 17 wt. % Cr, 1 wt. % Mn, 16 wt. % Mo, 1.5 wt. % Si, the balance Fe. The nominal composition of Delcrome® 200, for example, is 0.8 wt. % C, 4 wt. % Cr, 5 wt. % Mo, 6 wt. % W, the balance Fe.

The metal alloys described above are added to the slurry as powders. In the currently preferred embodiments, they are added as pre-alloyed powders. In embodiments wherein a fully dense or nearly fully dense finished article is desired, the powders are preferably very fine. Herein, the metal and metal alloy powders preferably have a mesh size of −70 (less than about 210 micrometers), more preferably a mesh size of −140 (less than about 105 micrometers), even more preferably about −200 (less than about 74 micrometers), such as about −270 (less than about 53 micrometers). In embodiments wherein the densification of the product is not as critical, larger particles may be used, such as about −35 (less than about 500 micrometers), −45 (less than 354 micrometers), −60 (less than 250 micrometers, or even −70 (less than 210 micrometers). Powders having the above particle sizes may be formed by means known in the art, including milling, atomization, chemical deposition, and other methods.

The metal slurry further comprises a binder, which may be selected from among methyl cellulose, polyvinyl alcohol, polyvinyl butyrol, acrylic, among others. Applicable binders are materials that have the ability to bind to the pre-alloyed metal powders to each other and to the green part, such that when the metal slurry is applied, the binder holds the metal powders together and to the surface of the green part.

The metal slurry may optionally comprise a defoaming agent. A defoaming agent is generally preferred to reduce or eliminate air bubbles that may be formed during slurry preparation and to ensure complete coverage of the green part during coating. Defoaming agents useful for adding to the metal slurry include silicone emulsions, i.e., aqueous emulsions comprising polymerized siloxanes, for example polydimethylsiloxane (dimethicone). Silicone emulsions are available from a wide variety of commercial sources, including Defoam FG-10 available from Syndel Laboratories LTD., DCH-10 Antifoam available from Ransom & Randolph, Supreme Silicones Antifoam Emulsion, Silicone Emulsion from M.R. Silicone Industries, Silicone Concentrates from ClearCo Products, Dow Corning DSP Antifoam Emulsion, and so forth.

The metal slurry may optionally comprise a wetting agent, which aids in wetting the surface of the green part during coating. Applicable wetting agents include non-ionic surfactants such as those comprising polyether groups, based on, for example, ethylene oxide (EO) repeat units and/or propylene oxide (PO) repeat units. These surfactants may comprise blocks of EO repeat units and PO repeat units, for example, a block of EO repeat units encompassed by two blocks of PO repeat units or a block of PO repeat units encompassed by two blocks of EO repeat units. Another class of polyether surfactants comprises alternating PO and EO repeat units. Within these classes of surfactants are the polyethylene glycols, polypropylene glycols, and the polypropylene glycol/polyethylene glycols.

Yet another class of non-ionic surfactants comprises EO, PO, or EO/PO repeat units built upon an alcohol or phenol base group, such as glycerol ethers, butanol ethers, pentanol ethers, hexanol ethers, heptanol ethers, octanol ethers, nonanol ethers, decanol ethers, dodecanol ethers, tetradecanol ethers, phenol ethers, alkyl substituted phenol ethers, α-naphthol ethers, and β-naphthol ethers.

Non-ionic wetting agents are available from a wide variety of commercial sources. For example, a β-naphthol derivative non-ionic surfactant is Lugalvan BNO12 which is a β-naphtholethoxylate having 12 ethylene oxide monomer units bonded to the naphthol hydroxyl group. A similar surfactant is Polymax NPA-15, which is a polyethoxylated nonylphenol. Polyethoxylated nonylphenols are also sold under the Tergitol® trade name by Dow Chemical. Another surfactant is Triton®-X100 nonionic surfactant, which is an octylphenol ethoxylate. Additional commercially available non-ionic surfactants include the Pluronic® series of surfactants of EO/PO block copolymers, available from BASF. Another class of nonionic polyether surfactants includes low foaming surfactants, such as the Triton CF series. Nonionic surfactants are also available from Ransom & Randolph, including Wet-it, and from Akzo Nobel, such as the Berol series of alcohol ethoxylates.

The order of component addition during metal slurry preparation is not narrowly critical to the efficacy of the invention. Typically, the metal powder is added to the solvent, followed by the binder, but the order of addition may vary. The slurry composition is generally prepared with mixing, such as with a magnetic stir bar, stirring rod or paddle, or a rotating shaft, or with agitation, such as with a shaker or paint mixer. The slurry is stirred or mixed for duration sufficient to homogenize the slurry. The metal slurry may be prepared in any ambient atmosphere and pressure, although applying a vacuum is advantageous for removing air bubbles. It is advantageous to allow the metal slurry to rest, prior to coating the green part. Adequate rest periods may range from about 1 hour to 2 days, with 24 hours being a preferred resting duration.

The surface of the green part may be coated with the metal slurry by a variety of methods, such as immersion by dipping, spraying, cascading, or other means as are known. Preferably, the green part is simply dipped into the metal slurry. The metal slurry may be maintained at any temperature during slurry coating, and, if the solvent is water, room temperature is preferred. In some embodiments, the temperature may be controlled to influence the coating thickness. Preferably, the metal slurry temperature is between about 5° C. and about 30° C. Preferably, the metal slurry is agitated when the green part is submerged in the slurry to achieve even coating. The green part may be dipped once or more than once (i.e., twice, three times, four times, or more) to enhance the coating thickness. Preferably, the green part is not rinsed between dips. Dipping in this manner may be used to coat the green part with a slurry coating in a matter of seconds with a powdered metallic shell as thin about 20 micrometers to as thick as about 20 millimeters with preferred thickness for thin walled articles between about 50 micrometers and about 10 millimeters, or between about 50 micrometers and about 5 millimeters, or between about 50 micrometers and about 1 millimeter.

A preformed substrate may be coated with slurry to the desired thickness, according to the method of the present invention, in as little as three seconds.

After the dipping stage, the slurry coated preformed substrate is dried to remove the solvent. Drying may occur in air at room temperature, and the solvent may be substantially evaporated within a few hours. Drying may be expedited to as little as a few minutes, such as between about 15 minutes to an hour, by increasing the temperature, such as between about 60° C. and about 150° C., by applying a vacuum, or by blow drying, but these steps are not necessary for achieving a fully densified, high quality final product. Solvent removal yields a coating layer having green strength, i.e., the coating layer has sufficient tensile strength to be removed from the preformed substrate without undergoing distortion.

After solvent evaporation, the coated preformed substrate is subject to a heat cycle to remove the binder, to sinter the green part into a hardened core and to densify the metal part into a continuous, densified shell layer over the core.

In one exemplary embodiment, the heat cycle may comprise a low temperature portion, such as between about 200° C. and about 500° C. wherein the binder is evaporated followed by a high temperature portion, such as between about 900° C. and about 1350° C., such as between about 950° C. and about 1050° C. wherein the core metal powder is hardened and the shell metal powders are sintered and densified. The heating process may be between about 10 minutes and about 5 hours, such as between about 30 minutes and about 3 hours. In this heating cycle, the temperature is below the solidus temperature of the core metal alloy and is between the solidus and liquidus temperature of the shell metal alloy. Bonding is accomplished by way of diffusion (i.e., atomic migration between powder particles), and the process affirmatively avoids super-liquidus melting.

A wide variety of parts, such as component parts used in the automotive industry especially coated gears having a wear resistant surface, may be manufactured according to the process of the present invention.

Having described the invention in detail, it will be apparent that modifications and variations are possible without departing from the scope of the invention defined in the appended claims.

EXAMPLES

The following non-limiting examples are provided to further illustrate the present invention.

Example 1

Preparation of an Article Comprising a Metallic Core and Metallic Shell According to the Present Invention FIG. 1 is a picture of a gear manufactured according to the process of the present invention. The core green part was manufactured from an iron-based alloy containing manganese, chromium, molybdenum and carbon as alloying elements and the shell was manufactured from highly wear resistant Tribaloy® T-400, available from Deloro Stellite Company, Inc.

The core green part was manufactured from a composition comprising FL-4205 powder (0.4 wt. % C, 0.5 wt. % Ni, 0.7 wt. % Mo, balance Fe) having a particle size of −60 mesh (less than 250 micrometers) and stearic acid lubricant. The composition was placed into a die for molding the metal powder into the shape of the gear and compacted at 40 tons/in$^2$ (about 617 MPa).

The metal slurry comprised 90 wt. % Tribaloy® T-400 powder having a particle size of −325 mesh (less than 44 micrometers), 9 wt. % water, and 1 wt. % methylcellulose binder.

The green part was dipped into the metal slurry twice, yielding a coating thickness between about 135 and about 250 microns. The solvent was evaporated at about 150° C., followed by sintering at about 1200° C. The hardness of the surface of the final composite product was 55 HRC (Rockwell Hardness Scale), and the surface density was 99% of theoretical (theoretical density of 8.5 g/cm$^3$).

When introducing elements of the present invention or the preferred embodiments(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above products and methods without departing from the scope of the invention, it is intended that all matter contained in the above description and shown in the accompanying drawing shall be interpreted as illustrative and not in a limiting sense.

What is claimed is:

1. A method for preparing an article, the method comprising:

compacting a mixture of a first pre-alloyed powder and a lubricant to thereby form a green part having a green strength sufficient to permit mechanical handling;

applying a slurry to a surface of the green part to thereby form a slurry coated green part, wherein the slurry comprises a second pre-alloyed powder, a binder, and a solvent;

wherein the first pre-alloyed powder is a Ni-based, Co-based, or Fe-based powder, and the second pre-alloyed powder is Ni-based or Co-based powder; and heating the coated green part to a temperature below the solidus temperature of the first pre-alloyed powder and between the solidus temperature and the liquidus temperature of the second pre-alloyed powder to thereby solid state sinter the first pre-alloyed powder into a sintered core and to liquid state sinter the second pre-alloyed powder into a continuous alloy coating over the sintered core.

2. The method of claim 1 further comprising drying the slurry-coated green part to remove the solvent between the applying step and the heating step.

3. The method of claim 1 further comprising:

drying the slurry-coated green part to remove the solvent between the applying step and the final heating step; and heating the coating layer to a temperature between about 200° C. and about 500° C. to remove the binder before the final heating step.

4. The method of claim 1 wherein the heating to a temperature between the solidus temperature and the liquidus temperature of the second pre-alloyed powder comprises heating to a temperature between about 900° C. and about 1350° C.

5. The method of claim 1 wherein the first pre-alloyed powder is a Fe-based powder and the second pre-alloyed powder is Co-based alloy powder comprising between about 21 wt % and about 35 wt % Cr, between about 4 wt % and about 19 wt % W, up to about 3 wt % Ni, up to about 5 wt % Fe, between about 0.4 wt % and about 3.5 wt % C, up to about 1.5 wt % Mn, between about 0.1 wt % and about 1.5 wt % Si, and up to about 1.5 wt % Mo, and the balance Co.

6. The method of claim 1 comprising, in sequence:

compacting the mixture of the first pre-alloyed powder and the lubricant to thereby form the green part having the green strength sufficient to permit mechanical handling;

applying the slurry to the surface of the green part to thereby form the slurry coated green part, wherein the slurry comprises the second pre-alloyed powder, the binder, and the solvent;

drying the slurry-coated green part to remove the solvent;

heating the coating layer to a temperature between about 200° C. and about 500° C. to remove the binder;

heating the coated green part to the temperature below the solidus temperature of the first pre-alloyed powder and between the solidus temperature and the liquidus temperature of the second pre-alloyed powder to thereby solid state sinter the first pre-alloyed powder into the sintered core and to liquid state sinter the second pre-alloyed powder into the continuous alloy coating over the sintered core.

7. The method of claim 1 comprising, in sequence:

compacting the mixture of the first pre-alloyed powder and the lubricant to thereby form the green part having the green strength sufficient to permit mechanical handling;

applying the slurry to the surface of the green part to thereby form the slurry coated green part, wherein the slurry comprises the second pre-alloyed powder, the binder, and the solvent;

drying the slurry-coated green part to remove the solvent;

heating the coating layer to a temperature between about 200° C. and about 500° C. to remove the binder;

heating the coated green part to a temperature between about 900° C. and about 1350° C. to thereby solid state sinter the first pre-alloyed powder into the sintered core and to liquid state sinter the second pre-alloyed powder into the continuous alloy coating over the sintered core.

8. The method of claim 1 wherein a ratio of weight of the second pre-alloyed powder to weight of the solvent is from 2:1 to about 15:1.

9. The method of claim 1 wherein a ratio of weight of the second pre-alloyed powder to weight of the solvent is from about 6:1 to about 13:1.

10. The method of claim 1 wherein a ratio of weight of the second pre-alloyed powder to weight of the solvent is from about 9:1 to about 11:1.

11. The method of claim 1 wherein the first pre-alloyed powder is a Fe-based powder and the second pre-alloyed powder is Co-based alloy powder comprising between about 26 wt % and about 34 wt % Cr, between about 4 wt and about 18 wt % Mo, up to about 3 wt % Ni, up to about 3 wt % Fe, between about 0.2 wt % and about 3 wt % C, up to about 1.5 wt % Mn, between about 0.5 wt % and about 1.5 wt % Si, up to about 0.5 wt % B, and the balance Co.

12. The method of claim 1 wherein the first pre-alloyed powder is a Fe-based powder and the second pre-alloyed powder is Co-based alloy powder comprising between about 26 wt % and about 33 wt % Cr, up to about 14 wt % Mo, between about 0.1 wt % and about 3.5 wt % C, up to about 1 wt % Mn, up to about 1.5 wt % Si, balance Co, and one or both of between about 8 wt % and about 20 wt % Fe and between about 1 wt % and about 8 wt % Ni.

13. The method of claim 1 wherein the first pre-alloyed powder is a Fe-based powder and the second pre-alloyed powder is Co-based alloy powder comprising between about 8 and about 18 wt % Cr, between about 20 and about 33 wt % Mo, between about 0.5 and about 4 wt % Si, and balance cobalt.

14. The method of claim 1 wherein the first pre-alloyed powder is a Fe-based powder and the second pre-alloyed powder is Ni-based alloy powder comprising between about 14 and 28 wt % Cr, between about 24 and about 34 wt % Mo, between about 1 and about 4 wt % Si, up to about 0.1 wt % C, up to about 3 wt % Fe, up to about 2 wt % Co, and balance Ni.

15. The method of claim 1 wherein the first pre-alloyed powder is a Fe-based powder and the second pre-alloyed powder is Ni-based alloy powder comprising between about 0.2 and about 6 wt %. Fe, between about 0.5 and about 4 wt %. B, between about 1 and about 5 wt. % Si, between about 0.03 to about 1 wt. % C, and balance Ni.

16. A method for preparing an article, the method comprising:

compacting a mixture of a first pre-alloyed powder and a lubricant to thereby form a green part having a green strength sufficient to permit mechanical handling;

applying a slurry to a surface of the green part to thereby form a slurry coated green part, wherein the slurry comprises a second pre-alloyed powder, a binder, and a solvent;

heating the coated green part to a temperature below the solidus temperature of the first pre-alloyed powder and between the solidus temperature and the liquidus temperature of the second pre-alloyed powder to thereby solid state sinter the first pre-alloyed powder into a sintered core and to liquid state sinter the second pre-alloyed powder into a continuous alloy coating over the sintered core;

wherein the first pre-alloyed powder is a Fe-based powder and the second pre-alloyed powder is a Co-based alloy powder comprising between about 20 wt % and about 35 wt % Cr, between about 2 wt % and about 15 wt % W, between about 6 wt % and about 24 wt % Ni, up to about 4 wt % Fe, between about 0.1 wt % and about 2 wt % C, up to about 1.5 wt % Mn, between about 0.3 wt % and about 3 wt % Si, up to about 3 wt % B, and the balance Co.

17. A method for preparing an article, the method comprising:

compacting a mixture of a first pre-alloyed powder and a lubricant to thereby form a green part having a green strength sufficient to permit mechanical handling;

applying a slurry to a surface of the green part to thereby form a slurry coated green part, wherein the slurry comprises a second pre-alloyed powder, a binder, and a solvent, wherein a ratio of weight of the second pre-alloyed powder to weight of the solvent is from 2:1 to about 15:1;

wherein the first pre-alloyed powder is a Ni-based, Co-based, or Fe-based powder, and the second pre-alloyed powder is Ni-based or Co-based powder; and heating the coated green part to a temperature between about 900° C. and about 1350° C. to thereby sinter the first pre-alloyed powder into a sintered core and to sinter the second pre-alloyed powder into a continuous alloy coating over the sintered core.

18. The method of claim 17 further comprising drying the slurry-coated green part to remove the solvent between the applying step and the heating step.

19. The method of claim 17 further comprising:

drying the slurry-coated green part to remove the solvent between the applying step and the final heating step; and heating the coating layer to a temperature between about 200° C. and about 500° C. to remove the binder before the final heating step.

20. The method of claim 17 wherein said heating is to a temperature between about 950° C. and about 1050° C.

21. The method of claim 17 wherein the ratio of weight of the second pre-alloyed powder to weight of the solvent is from about 6:1 to about 13:1.

22. The method of claim 17 wherein the ratio of weight of the second pre-alloyed powder to weight of the solvent is from about 9:1 to about 11:1.

23. A method for preparing an article, the method comprising:

compacting a mixture of a first pre-alloyed powder and a lubricant to thereby form a green part having a green strength sufficient to permit mechanical handling;

applying a slurry to a surface of the green part to thereby form a slurry coated green part, wherein the slurry comprises a second pre-alloyed powder, a binder, and a solvent;

heating the coated green part to a temperature between about 900° C. and about 1350° C. to thereby sinter the first pre-alloyed powder into a sintered core and to sinter the second pre-alloyed powder into a continuous alloy coating over the sintered core;

wherein the first pre-alloyed powder is a Fe-based powder and the second pre-alloyed powder is Co-based alloy powder comprising between about 21 wt % and about 35 wt % Cr, between about 4 wt % and about 19 wt % W, up to about 3 wt % Ni, up to about 5 wt % Fe, between about 0.4 wt % and about 3.5 wt % C, up to about 1.5 wt % Mn, between about 0.1 wt % and about 1.5 wt % Si, and up to about 1.5 wt % Mo, and the balance Co.

24. A method for preparing an article, the method comprising:

compacting a mixture of a first pre-alloyed powder and a lubricant to thereby form a green part having a green strength sufficient to permit mechanical handling;

applying a slurry to a surface of the green part to thereby form a slurry coated green part, wherein the slurry comprises a second pre-alloyed powder, a binder, and a solvent;

heating the coated green part to a temperature between about 900° C. and about 1350° C. to thereby sinter the first pre-alloyed powder into a sintered core and to sinter the second pre-alloyed powder into a continuous alloy coating over the sintered core;

wherein the first pre-alloyed powder is a Fe-based powder and the second pre-alloyed powder is Co-based alloy powder comprising between about 20 wt % and about 35 wt % Cr, between about 2 wt % and about 15 wt % W, between about 6 wt % and about 24 wt % Ni, up to about 4 wt % Fe, between about 0.1 wt % and about 2 wt % C, up to about 1.5 wt % Mn, between about 0.3 wt % and about 3 wt % Si, up to about 3 wt % B, and the balance Co.

25. A method for preparing an article, the method comprising:

compacting a mixture of a first pre-alloyed powder and a lubricant to thereby form a green part having a green strength sufficient to permit mechanical handling;

applying a slurry to a surface of the green part to thereby form a slurry coated green part, wherein the slurry comprises a second pre-alloyed powder, a binder, and a solvent;

heating the coated green part to a temperature below the solidus temperature of the first pre-alloyed powder and between the solidus temperature and the liquidus temperature of the second pre-alloyed powder to thereby solid state sinter the first pre-alloyed powder into a sintered core and to liquid state sinter the second pre-alloyed powder into a continuous alloy coating over the sintered core;

wherein the first pre-alloyed powder is a Fe-based powder and the second pre-alloyed powder is a Fe-based alloy powder comprising between about 4 and about 10 wt. % Co, between about 0.6 and about 5 wt. % C, between about 2 and about 30 wt. % Cr, between about 0.1 and about 4 wt. % Mn, between about 4 and about 22 wt. % Mo, between about 0.5 and about 3 wt. % Si, between about 3 and about 9 wt. % W, and balance Fe.

* * * * *